US010538078B2

(12) United States Patent
Schwiertz et al.

(10) Patent No.: US 10,538,078 B2
(45) Date of Patent: Jan. 21, 2020

(54) CYLINDER HAVING A PARTIALLY GAS-PERMEABLE SURFACE

(71) Applicant: Flint Group Germany GmbH, Stuttgart (DE)

(72) Inventors: Martin Schwiertz, Emsbüren (DE); Klaus Bennink, Vreden (DE); Uwe Müller, Ahaus (DE); Alfred Leinenbach, Oberkirch-Nußbach (DE); Martin Schnell, Ahaus (DE)

(73) Assignee: Flint Group Germany GmbH, Stuttgart (DE)

( * ) Notice: Subject to any disclaimer, the term of this patent is extended or adjusted under 35 U.S.C. 154(b) by 0 days.

(21) Appl. No.: 16/098,459

(22) PCT Filed: May 8, 2017

(86) PCT No.: PCT/EP2017/060868
§ 371 (c)(1),
(2) Date: Nov. 2, 2018

(87) PCT Pub. No.: WO2017/194440
PCT Pub. Date: Nov. 16, 2017

(65) Prior Publication Data

US 2019/0143671 A1 May 16, 2019

(30) Foreign Application Priority Data

May 9, 2016 (EP) ..... 16168747

(51) Int. Cl.
*B41F 27/14* (2006.01)
*B41F 13/10* (2006.01)
(Continued)

(52) U.S. Cl.
CPC ..... *B41F 27/14* (2013.01); *B41F 5/24* (2013.01); *B41F 13/10* (2013.01); *B41F 27/105* (2013.01); *B41F 25/00* (2013.01)

(58) Field of Classification Search
CPC ..... B41F 13/10; B41F 13/16; B41F 27/10; B41F 27/105; B41F 27/14; B41F 5/24; B41N 1/22; B41N 6/00
(Continued)

(56) References Cited

U.S. PATENT DOCUMENTS 4,601,928 A * 7/1986 van der Velden ..... B41C 1/182 101/368
2003/0131746 A1* 7/2003 Smoot ..... B41F 27/105 101/375

FOREIGN PATENT DOCUMENTS

EP 0705785 A2 4/1996
EP 1263592 B1 9/2004

OTHER PUBLICATIONS

International Preliminary Report on Patentability with English Translation for International Application No. PCT/EP2017/060868, dated Nov. 13, 2018.
(Continued)

*Primary Examiner* — Leslie J Evanisko
(74) *Attorney, Agent, or Firm* — Drinker Biddle & Reath LLP

(57) ABSTRACT

A cylinder (10) comprising a cylindrical body (11) is provided. A first proportion of the circumferential face (48) of the cylindrical body (11) is of porous and gas-permeable configuration and a second proportion of the circumferential face (48) of the cylindrical body (11) is of gas-impermeable configuration, wherein the porous, gas-permeable first proportion of the circumferential face (48) is in communication with at least one gas supply line and wherein the first proportion of the circumferential face (48) amounts to at
(Continued)

least 0.1% and at most 50%. Further, a corresponding adapter sleeve and a corresponding printing forme cylinder are provided.

17 Claims, 7 Drawing Sheets

(51) Int. Cl.
*B41F 27/10* (2006.01)
*B41F 5/24* (2006.01)
*B41F 25/00* (2006.01)

(58) Field of Classification Search
USPC ..... 101/375, 376, 389.1; 492/45, 47, 48
See application file for complete search history.

(56) References Cited

OTHER PUBLICATIONS

International Search Report for PCT/EP2017/060868 dated Aug. 25, 2017.
Written Opinion of the International Searching Authority for PCT/EP2017/060868 dated Aug. 25, 2017.

* cited by examiner ( PRIOR ART )

( PRIOR ART )

CYLINDER HAVING A PARTIALLY GAS-PERMEABLE SURFACE

CROSS-REFERENCE TO RELATED APPLICATIONS

This application is a national stage application (under 35 U.S.C. § 371 ) of PCT/EP2017/060868, filed May 8, 2017, which claims benefit of European Application No. 16168747.0, filed May 9, 2016, both of which are incorporated herein by reference in their entirety.

PRIOR ART

The invention relates to printing cylinders and adapter sleeves for flexographic printing. Flexographic printing is a letterpress printing process, where a highly mobile printing ink is transferred from the raised portions of the printing forme onto a substrate. A feature of flexographic printing is the use of flexible printing formes, allowing a host of substrates (paper, cardboard, films) to be printed. Alongside offset printing and gravure printing, flexographic printing is one of the most important printing processes in the packaging industry.

With the flexographic printing machines, a distinction is made between multicylinder and central-cylinder printing machines. In the case of a central-cylinder printing machine, the individual printing units are arranged around a central cylinder, over which the substrate web is passed. In the case of multicylinder printing machines, the individual printing units are arranged in series. The printing units consist of the printing forme cylinder, an engraved roll for inking the printing forme, and an ink trough from which the printing ink goes onto the engraved roll. At its most simple, the printing forme cylinder consists of a steel roll, onto which the flexographic printing forme is adhered.

A great advantage of flexographic printing over other printing processes is its format variability. Through use of steel cylinders as printing forme cylinders with different diameters, it is possible for different formats to be printed. A term used by the skilled person is that of the repeat length. The repeat length corresponds to the printed length on one complete rotation of the printing forme cylinder. Changing over the heavy steel cylinders, however, takes time. Accordingly, flexographic printing machines are nowadays available with which the repeat length can be altered more simply by means of adapter sleeves. The adapter sleeve is engaged onto the steel cylinder. The wall thicknesses of customary adapter sleeves range from 7 mm to 300 mm. Engaged onto the adapter sleeve subsequently is a printing sleeve, which carries the printing forme, usually premounted. Adapter sleeves and printing sleeves are nowadays generally also referred to as sleeves. Sleeves are manufactured of plastic. They are significantly lighter than corresponding steel cylinders, and can therefore be changed over much more easily in the printing machine.

The construction of a sleeve is usually as follows (from inside to outside):

Over a thin layer of GRP material (GRP=glass fiber-reinforced plastic) is a thin compressible layer, which is covered in turn by a second thin layer of GRP material. This layer system allows the sleeves to be expanded by means of compressed air, and is referred to hereinafter as a GRP base sleeve. The GRP base sleeve customarily has a thickness of 1 mm up to 4 mm. Applied to the GRP base sleeve is a polyurethane foam layer with a thickness of several mm to several cm. The function of this layer is to build up the layer thickness, or to produce the desired repeat length. Usually, the polyurethane foam layer carries a further thin GRP layer or a thin outer layer, to ensure the mechanical and chemical stability of the sleeve.

In order to ensure that the adapter sleeve is simple to engage, the printing forme cylinders have air bores which emit a flow of compressed air. As a result of the compressed air, an air cushion is built up, thereby expanding the internal diameter of the adapter sleeve, and the adapter sleeve glides over the printing forme cylinder. If the supply of air is halted, the adapter sleeve clamps to the printing forme cylinder and is firmly fixed on it. This operation is shown diagrammatically in FIG. 1.

To allow the printing sleeve to be pulled onto the adapter sleeve, the adapter sleeve likewise contains an air conduction system. In the prior art there are two known systems here. Either the compressed air is conducted on directly from the printing forme cylinder (bridge system), or there is a separate air connection to one of the end faces of the adapter sleeve (Airo system).

In the case of the bridge system, the adapter has air channels which extend from the adapter sleeve inside to the outside of the adapter sleeve, thus allowing the compressed air emerging from the printing forme cylinder to generate an air cushion over the adapter sleeve as well (see FIG. 2).

An adapter sleeve according to the bridge system is known from EP 1 263 592 B1. The adapter sleeve comprises a hollow, cylindrical tube, which can be pulled onto a printing cylinder. The adapter sleeve has channels which extend radially from inside to outside and which end in openings on the surface.

With the Airo system, the compressed air enters at the end face of the adapter sleeve and is then conducted on by means of air channels and/or compressed air hoses to the surface of the adapter (see FIG. 3). In this case, however, as well as the compressed air connection for the printing forme cylinder, a second, external compressed air connection is required.

Both systems are nowadays established in the market, but also have a number of drawbacks. To build up a sufficient air cushion, a high minimum volume of compressed air is needed. Because the compressed air has to escape through the relatively narrow openings or air bores, the associated noise level is high. At more than 80 dB, it is above the noise limits stipulated, for example, in the German Workplace Ordinance (ArbStättV). The compressed air volume required is approximately 500 l/min. This entails a high air outflow velocity, which may carry an increased risk of accident owing to emergence of particles, for example.

These drawbacks relate equally to the printing forme cylinders known in the prior art, which likewise provide an air cushion for the pulling-on of the adapter sleeves. Here as well, owing to the relatively narrow openings, there is a high noise level and there are high air outflow velocities.

DISCLOSURE OF THE INVENTION

A cylinder is proposed which comprises a cylindrical body. In the case of this cylinder, a first proportion of the circumferential face of the cylindrical body is of porous and gas-permeable configuration and a second proportion of the circumferential face of the cylindrical body is of gas-impermeable configuration, where the porous, gas-permeable first proportion of the circumferential face is in communication with at least one gas supply line, and where the first proportion of the circumferential face amounts to at least 0.1% and at most 50%. The first proportion of the circumferential face is preferably in the range from 0.1% to 20%, more preferably in the range from 0.1% to 10%, and very preferably in the range from 0.2% to 5%. Furthermore, the second proportion of the circumferential face amounts preferably to at least 50% and at most 99.9%, with the sum total of the first proportion and the second proportion amounting preferably to 100%. The second proportion of the circumferential face amounts preferably to at least 80%, more preferably at least 90%, and very preferably at least 95%.

The porous proportion is preferably located at one end of the cylinder, at a distance of 1-100 mm, more preferably 5 to 50 mm, from the cylinder end.

The cylinder is more particularly an adapter sleeve or a printing forme cylinder for flexographic printing.

Where the cylinder of the invention is configured as an adapter sleeve, it has a sleeve body which corresponds substantially to those of the adapter sleeves known from the prior art. The sleeve body has a tube form or the form of a hollow circular cylinder, and preferably, viewed from inside to outside, comprises an expandable base sleeve, a foam layer, and an outer layer. In particular, the base sleeve, the foam layer, and the outer layer correspond substantially to those of the adapter sleeves of the prior art. The foam used for the foam layer is preferably a polyurethane foam. A first proportion of the circumferential face of the sleeve body is of porous and gas-permeable configuration, and a second proportion of the circumferential face of the sleeve body is of gas-impermeable configuration.

Where the cylinder of the invention is configured as a printing forme cylinder for a flexographic printing machine, the cylinder comprises a roll body. A first proportion of the circumferential face of the roll body is of porous and gas-permeable configuration, and a second proportion of the circumferential face of the roll body is of gas-impermeable configuration.

In contrast to the adapter sleeves known from the prior art, instead of the openings on the surface, the adapter sleeves of the invention feature a porous and gas-permeable configuration on a small proportion of the circumferential face. In order to give a portion of the circumferential face a porous and gas-permeable configuration, it is possible to use either materials of fine porosity or else materials having a high proportion of openings per unit area. Materials of these kinds may have sievelike, rakelike, lamellar or slot-shaped openings.

A material qualifying as a material with a high proportion of openings has at least one opening per 500 $mm^2$ area. The material with a high proportion of openings preferably has at least one opening per 200 $mm^2$ area. The diameter of the openings in this case is in the range from 0.1 mm to 1.5 mm, and the number of openings is greater than 8, preferably greater than 10, and more preferably greater than 12. The openings may be distributed regularly or irregularly over the periphery and may be arranged in one or more rows.

The proportional area of the openings on the external surface of the material with a high proportion of openings that forms the porous portion of the circumferential face is, for example, in the range from 0.3% to 90%. The proportional area of the openings on the surface of the porous portion of the circumferential face is preferably from 10% to 90%. Particular preference is given here to a proportional area of the openings in the range from 15% to 80%, and very particular preference to a proportional area of the openings in the range from 20% to 60%. For example, the proportional area of the openings is in the range from 0.3% to 50%. The openings are implemented as continuous or branched openings or channels and are in communication with the gas supply line. The diameter of the openings or the width of the channels or slots is in the range from 100 μm to 5 mm, preferably in the range from 500 μm to 2 mm. The gas more particularly is air, which is supplied to the cylinder in the form of compressed air.

Materials of fine porosity are understood to be those materials for which the pores occupy a proportional volume in the range of 1% and 50%, more preferably in the range from 5% to 40%, and very preferably in a range from 10% to 30% of the material. The percentage here is based on the proportional volume of the pores within the volume of the porous material as a whole. The pore size is in the range from 1 μm to 500 μm, preferably from 2 μm to 300 μm, preferably from 5 μm to 100 μm, and very preferably from 10 μm to 50 μm. The pores are preferably distributed homogeneously over the volume of the material of fine porosity. Examples of such materials are foamed materials with open cells, or sintered porous materials.

The permeability is determined for example in accordance with ISO 4022:1987, where for a given volume flow rate, at constant pressure and temperature, a measurement is made of the pressure loss after fluid permeation of the porous material with a given filter area, and the fluid permeability coefficients $\alpha$ for laminar flow and $\beta$ for turbulent flow are ascertained.

The porous materials of the invention preferably have a value for a of greater than $0.01*10^{-12}$ $m^2$ and a value for $\beta$ of greater than $0.01*10^{-7}$ m. With particular preference the porous materials have a value of value for $\alpha$ of greater than $0.05*10^{-12}$ $m^2$ and a value for $\beta$ of greater than $0.1*10^{-7}$ m.

The porous, gas-permeable first proportion of the circumferential face is preferably divided into a porous region or into a plurality of porous regions. A porous region here is configured preferably as a ring circulating in peripheral direction, or a porous region comprises a plurality of subregions which are configured and disposed in the form of an interrupted ring circulating in peripheral direction. The width of a ring is preferably in the range from 1 cm to 20 cm and more preferably in the range from 5 cm to 15 cm.

Alternatively or additionally, at least one porous region may be provided in the form of an axially extending strip.

The gas employable extends to all gases; preferably, compressed air is used. In certain circumstances it may be advisable to use inert gases (examples being nitrogen, argon, helium, or CO2), in order to prevent fire or explosions, or in order to prevent or reduce unwanted reactions (e.g., oxidation) of products or components. The gases are usually used under superatmospheric pressure, so as to allow the generation of a corresponding gas cushion, and the pressures, depending on specific application, vary from 1 bar to 30 bar, preferably 4 to 8 bar.

Surprisingly it has been found that through the provision of a porous portion of the circumferential face, or through the provision of porous regions on the circumferential face, the gas cushion which can be generated is very much more uniform by comparison with individual gas openings, thereby making it possible, for example, for a printing sleeve to be engaged onto an adapter sleeve and, in particular, allowing a marked reduction in the noise level involved in pulling the printing sleeve onto an adapter sleeve of the invention. The engagement of an adapter sleeve onto a printing forme cylinder is likewise made easier. In addition, it has been possible to reduce by a factor of 4 to 8 the gas throughput required for the engagement of the sleeves.

There is preferably at least one porous region adjoining at least one end of the cylindrical body. This ensures that the air cushion generated extends up to the end faces of the cylinder. In the case of an adapter sleeve, the air cushion extends to the end face of the adapter sleeve, and allows a printing sleeve to be easily pulled on.

The porous, gas-permeable proportion of the circumferential face of the cylindrical body is preferably formed of a porous material. The porous material in this case covers, correspondingly, in the range from 0.1% to 50% of the total circumferential face of the cylinder or of its cylindrical body. Preferably 0.1% to 20%, more preferably 0.1% to 10%, and very preferably 0.2% to 5% of the circumferential face is constructed from the porous material.

In order to make a portion of the circumferential face of the cylindrical body porous, the porous material on the porous, gas-permeable portions of the circumferential face is inserted into the cylindrical body.

In the case of an adapter sleeve, the porous material is inserted preferably into the foam layer of the sleeve body. At these points, therefore, the porous material replaces the outer layer of the sleeve body, and also a portion of the foam layer. The thickness of the porous material, viewed in the radial direction of the adapter sleeve or of the sleeve body, is preferably in the range from 2 mm to 50 mm. The porous material here is preferably configured and disposed in the sleeve body in such a way that the external surface of the porous material finishes flush with the circumferential face of the sleeve body or of the adapter sleeve. Alternatively, the porous material is disposed and configured in such a way that it stands slightly higher than the gas-impermeable portion of the circumferential face of the sleeve body, with preference being given to a projection in the range from 0.1 mm to 0.2 mm.

In the case of a printing forme cylinder, the porous, gas-permeable proportion of the circumferential face of the roll body is preferably formed from a porous material. To this end, the porous material at the porous, gas-permeable portions of the circumferential face is bonded, pressed, screwed, welded or soldered into the roll body. In this case as well, the porous material replaces a portion of the material of the printing forme cylinder. The thickness of the porous-material, viewed in the radial direction of the printing forme cylinder or of the roll body, is preferably in the range from 2 mm to 50 mm. The porous material here is preferably configured and disposed in the roll body in such a way that the external surface of the porous material finishes flush with the circumferential face of the roll body or of the printing forme cylinder. Alternatively, the porous material is disposed and configured in such a way that it stands slightly higher than the gas-impermeable portion of the circumferential face of the roll body, with preference being given to a projection in the range from 0.1 mm to 0.2 mm.

For the insertion of the porous material into the cylindrical body, an adhesive bonding technique is used with preference, although other joining techniques, such as pressing, screwing, soldering, and welding, for example, can also be employed. Adhesives in question include physically setting adhesives (examples being solvent-containing wet adhesives, dispersion-based adhesives, hotmelt adhesives, contact adhesives, and plastisols) and chemically curing adhesives (e.g., cyanoacrylate adhesives, methacrylic and acrylic adhesives, anaerobically curing adhesives, radiation-curable adhesives, phenol-formaldehyde adhesives, silicones, silane-crosslinking polymer adhesives, epoxy resin adhesives, polyurethane adhesives), and pressure-sensitive adhesives. A two-part epoxy resin is preferably used.

The material of fine porosity is preferably selected from a porous plastic, a porous, fiber-reinforced plastic, a porous metal, a porous alloy, a porous glass-ceramic, and a porous ceramic.

Examples of porous plastics contemplated include polyethylene (PE), polyamide (PA), or porous, glass-fiber-reinforced plastics materials (GRP materials).

Where the cylinder is configured as a printing forme cylinder, preferred material of fine porosity comprises, in particular, porous metals or alloys and porous ceramics. In this case the porous material is more preferably a porous aluminum or porous stainless steel.

The porosity of the material of fine porosity is preferably in the range of 1% and 50%, more preferably in the range from 5% to 40%, and very preferably in a range from 10% to 30%. The percentage here is based on the proportional volume of the pores within the volume of the porous material. The pore size is in the range from 1 μm to 500 μm, preferably from 2 μm to 300 μm, preferably from 5 μm to 100 μm, and very preferably from 10 μm to 50 μm.

Materials of fine porosity with a tailored pore size and pore volume are available commercially, for example, from the companies Exxentis and Tridelta Siperm. Classes of porous material particularly preferred are porous aluminum and porous stainless steel, which are available commercially from GKN Sinter Metals or from Bioenergie Rhein Ruhr GmbH, for example. These materials represent the best trade-off between high porosity or high gas permeability and good mechanical strength, and, furthermore, they are easy to machine. The porous metals can be produced with uniform porosity and uniform pore size by means of controlled sintering operations or by melting with salt, which is subsequently washed out of the material by means of water.

The porous material is incorporated into the circumferential face of the cylindrical body at locations where gas-permeable porous regions are intended. The porous material may be incorporated, for example, in the form of one or more rings or in the form of a plurality of partial rings into the circumferential face of the cylindrical body. Alternatively, the porous material may also be incorporated in the form of a plurality of platelets or else of an axially extending strip. With preference the porous material is worked flush with the remaining cylinder surface or stands slightly higher than the material of the remaining cylinder surface.

The cylinder is implemented preferably as an adapter sleeve comprising a sleeve body, in which case the sleeve body, viewed from inside to outside in this order, comprises an expandable base sleeve, a foam layer, and an outer layer. Furthermore, a first proportion of the circumferential face of the sleeve body is of porous and gas-permeable configuration and a second proportion of the circumferential face of the sleeve body is of gas-impermeable configuration, with the porous, gas-permeable first proportion of the circumferential face being in communication with at least one gas supply line, and with the first proportion of the circumferential face amounting to at least 0.1% and at most 50%. The first proportion of the circumferential face is preferably in the range from 0.1% to 20%, more preferably in the range from 0.1% to 10%, and very preferably in the range from 0.2% to 5%. Furthermore, the second proportion of the circumferential face is preferably at least 50% and at most 99.9%, and the sum total of the first proportion and the second proportion is preferably 100%. With preference the second proportion of the circumferential face is at least 80%, more preferably at least 90%, and very preferably at least 95%.

Surprisingly it has been found that a very good pull-on behavior is made possible just with simple constructions, in which only one end of the adapter sleeve is equipped with a ring of porous material or with a plurality of partial rings of porous material. The uniformity of the resultant air cushion is such that there is no need for any further porous material to be incorporated, and/or for any further air cushion to be generated, over the length of the adapter sleeve.

The porous material is therefore incorporated preferably in ring form at one end of the adapter sleeve. The rings preferably have a width of 1 cm to 20 cm, more preferably a width of 5 cm to 15 cm. The wall thickness of the ring is preferably a few millimeters, a preferred range being from 2 mm to 50 mm.

For providing the supply of compressed air, the bridge system or the Airo system can be employed with the adapter sleeve of the invention. In both cases, the adapter sleeve has at least one gas supply line, the gas supply line being configured preferably as a channel or as a groove in the foam layer.

If the compressed air is to be supplied in accordance with the Airo system, there is preferably at least one gas connection, communicating with the at least one gas supply line, at one end face of the adapter sleeve. The at least one gas supply line is configured, for example, in the form of at least one channel. If the supply of compressed air is configured as a bridge system, then at least one gas inlet in communication with at least one gas supply line is disposed preferably on the inside of the sleeve body. The gas inlet is implemented, for example, as an opening which, when the adapter sleeve has been pulled on a corresponding printing forme cylinder, is positioned over an air opening of the printing forme cylinder. The opening is in communication with the at least one air channel of the adapter sleeve, by way of a radially implemented groove, for example, and so compressed air provided through the printing forme cylinder reaches those portions of the circumferential surface that have a porous and gas-permeable design.

In one embodiment, hoses are introduced into the channels or into the grooves. The hoses are implemented as polyethylene (PE) hoses, for example. The hoses connect a gas connection or a gas inlet to a porous region. In the case of this connection of the hoses to the porous material, for example, valves are employed. For this purpose, a thread is drilled into the porous material, and the connection of the PE hose can be screwed into this thread.

With the adapter sleeves of the invention, surprisingly, it is possible for the air conduction system to be implemented entirely without compressed air hoses, solely through the provision of channels, the channels ending at the porous material. It is preferred for gas hoses not to be used. An advantage of this is that porous materials with a relatively low wall thickness can be used, since there is no need for a thread to be worked in. Furthermore, the construction of the gas conduction system is significantly simpler in its realization.

The channels preferably have a width of a few millimeters, preference being given to a width in the range from 2 mm to 6 mm.

A further aspect of the invention is that of providing a printing forme cylinder for a flexographic printing machine, the printing forme cylinder comprising a roll body. In the printing forme cylinder, a first proportion of the circumferential face of the roll body is of porous and gas-permeable configuration and a second proportion of the circumferential face of the roll body is of gas-impermeable configuration, with the porous, gas-permeable first proportion of the circumferential face being in communication with at least one gas supply line, and with the first proportion of the circumferential face amounting to at least 0.1% and at most 50%. The first proportion of the circumferential face is preferably in the range from 0.1% to 20%, more preferably in the range from 0.1% to 10%, and very preferably in the range from 0.2% to 5%. Furthermore, the second proportion of the circumferential face is preferably at least 50% and at most 99.8%, and the sum total of the first proportion and the second proportion is preferably 100%. With preference the second proportion of the circumferential face is at least 80%, more preferably at least 90%, and very preferably at least 95%.

The material of the printing forme cylinder, or the material of the roll body, is preferably selected from a metal, such as steel or aluminum, for example, or from a carbon and/or glass fiber-reinforced plastic. The printing forme cylinder is optionally provided with additional coatings, composed for example of chromium, copper or other metals, alloys, rubber, elastomers, or plastics.

The proposed printing forme cylinder is implemented preferably as a steel cylinder and corresponds substantially to the printing forme cylinders known from the prior art; however, instead of the customary air bores, a small proportion of the circumferential face of the printing forme cylinder is to be implemented as porous and gas-permeable.

With preference at least one porous region adjoins at least one end of the roll body of the printing forme cylinder. This ensures that the air cushion generated extends to the end faces of the printing forme cylinder and it is easy for an adapter sleeve or a printing sleeve to be pulled on.

Given the heightened requirements regarding the durability and strength of the printing forme cylinders relative to adapter sleeves, there is a preference for the porous material used to be porous stainless steel. The porous material is in communication with channels in the interior of the roll body. The channels in turn are in communication with a gas connection, which is disposed preferably in the axle of the printing forme cylinder.

A further aspect of the invention is the provision of an arrangement which comprises a cylinder of the invention on which a hollow cylindrical forme is disposed. The hollow cylindrical forme may more particularly be a printing forme, an adapter, or a sleeve.

In order to produce this arrangement, a method is proposed wherein a cylinder of the invention, more particularly a printing forme cylinder, is provided in a first step. In a subsequent step, the cylinder is connected to a gas supply and is charged with pressurized gas. The gas flows from the porous, gas-permeable proportion of the circumferential face of the cylinder, and forms an air cushion. This air cushion allows the hollow cylindrical forme to be applied subsequently to the cylinder. The hollow cylindrical forme applied is positioned on the cylinder and, after the positioning, the gas supply is disconnected. The disconnection of the gas supply causes the air cushion to disappear, and so the hollow cylindrical forme is now firmly disposed on the cylinder.

In a further embodiment of the invention, a cylinder of the invention, more particularly a printing forme cylinder, and at least one further cylinder of the invention may form an arrangement, in which case the at least one further cylinder is disposed on the cylinder.

For this purpose, the at least one further cylinder, an adapter sleeve, for example, can be pulled onto the printing forme cylinder.

In order to enable easy pulling of a printing forme onto an adapter sleeve which has already been pulled onto the printing forme cylinder, it is preferable if there are porous, gas-permeable regions both on the circumferential face of the printing forme cylinder and on the circumferential face of the adapter sleeve.

The porous and gas-permeable regions of the printing forme cylinder and of the at least one further cylinder are preferably arranged in such a way that they at least partially overlap one another and permit the passage of gas when the at least one further cylinder has been pulled onto the printing forme cylinder. In this way, rapid and simple changeover both of the adapter sleeves and of the printing sleeves, with reduced noise, is achieved. Moreover, only one gas connection on the printing forme cylinder is needed.

In order to produce this second arrangement described, a method is proposed wherein a first cylinder of the invention, more particularly a printing forme cylinder, is provided in a first step. In a subsequent step, the first cylinder is connected to a gas supply and charged with pressurized gas. The gas flows out from the porous, gas-permeable proportion of the circumferential face of the first cylinder and forms an air cushion. This air cushion enables subsequent engagement of a second cylinder of the invention onto the first cylinder. The second cylinder is positioned on the first cylinder, with the porous regions of the first cylinder and of the second cylinder preferably overlapping. After the positioning, the gas supply is disconnected. The disconnection of the gas supply causes the air cushion to disappear, and so the second cylinder is now firmly disposed on the first cylinder.

In the same way, optionally, further cylinders or a hollow forme can be pulled onto the resulting arrangement.

BRIEF DESCRIPTION OF THE FIGURES

In the figures,

FIG. 1 shows the pulling of an adapter sleeve 10' onto a printing forme cylinder 100' in accordance with the prior art. The printing forme cylinder 100' comprises a roll body 101 and has a compressed air connection 36, via which the printing forme cylinder is charged with compressed air. Via air channels in the interior of the printing forme cylinder 100' (not visible in FIG. 1), the compressed air passes to air bores 102' which open into the circumferential face 48 of the roll body 101. The compressed air emerges from the air bores 102' and generates an air cushion.

The adapter sleeve 10' is pulled in pull-on direction 104 onto the printing forme cylinder 100'; as a result of the action of the air cushion, the internal diameter of the adapter sleeve 10' is expanded and so the adapter sleeve 10' can be pulled on. When charging with compressed air is ended, the adapter sleeve 10' sits tightly on the printing forme cylinder 100'.

Figure 2:
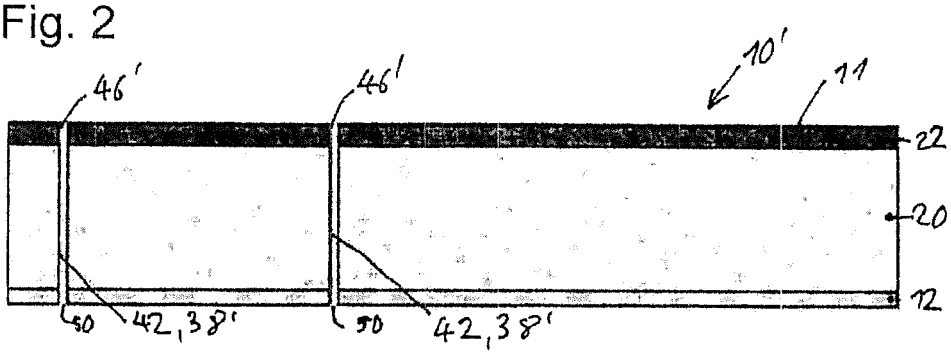
FIG. 2 shows a cross section of an adapter sleeve with bridge system in accordance with the prior art.

FIG. 2 shows a cross section of an adapter sleeve 10' with bridge system according to the prior art. The adapter sleeve 10' has a sleeve body 11, with a tubular configuration or configured in the form of a hollow circle cylinder. In the illustration in FIG. 2, only a detail of one wall of the adapter sleeve 10' is visible. From inside to outside, in this order, the sleeve body 11 has a base sleeve 12, a foam layer 20, and an outer layer 22.

Figure 3:
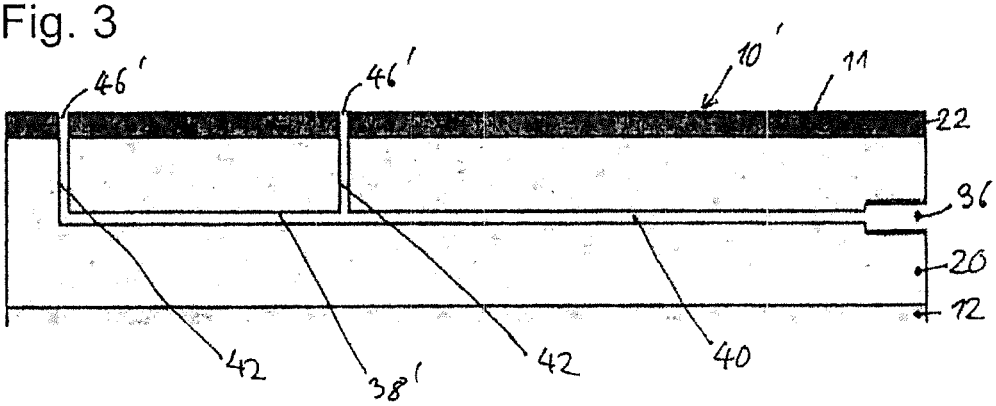
( PRIOR ART ) Fig. 3
FIG. 3 shows a cross section of an adapter sleeve with Airo system in accordance with the prior art.

Evident on the surface of the outer layer 22 are two air holes 46', which are in communication with an air supply line 50', in each case via an air channel 38' implemented as a radial groove 42. The air supply line 50' is configured as an opening on the inside of the adapter sleeve 10'. The configuration and arrangement of the air supply line 50' in this case is such that it is in communication with an air bore 102 of a printing forme cylinder 100' when the adapter sleeve 10' has been pulled onto a printing forme cylinder 100', FIG. 3 shows a cross section of an adapter sleeve 10' with Airo system according to the prior art. In the illustration in FIG. 3, only a detail of one wall of the adapter sleeve 10' is visible. The adapter sleeve 10' has a sleeve body 11, with a tubular configuration or configured in the form of a hollow circle cylinder. From inside to outside, in this order, the sleeve body 11 has a base sleeve 12, a foam layer 20, and an outer layer 22.

Evident on the surface of the outer layer 22 are two air holes 46', which are in communication with a further air channel 38', configured as an axial groove 42, in each case via an air channel 38' implemented as a radial groove 42. The axial groove 42 is in turn in communication with a compressed air connection 36, via which the adapter sleeve 10' can be charged with compressed air.

In the description below of the exemplary embodiments of the invention, elements that are identical or similar are denoted by the same reference symbols; in certain cases, a description of these elements is not repeated. The figures provide only a diagrammatic representation of the subject matter of the invention.

Figure 4:
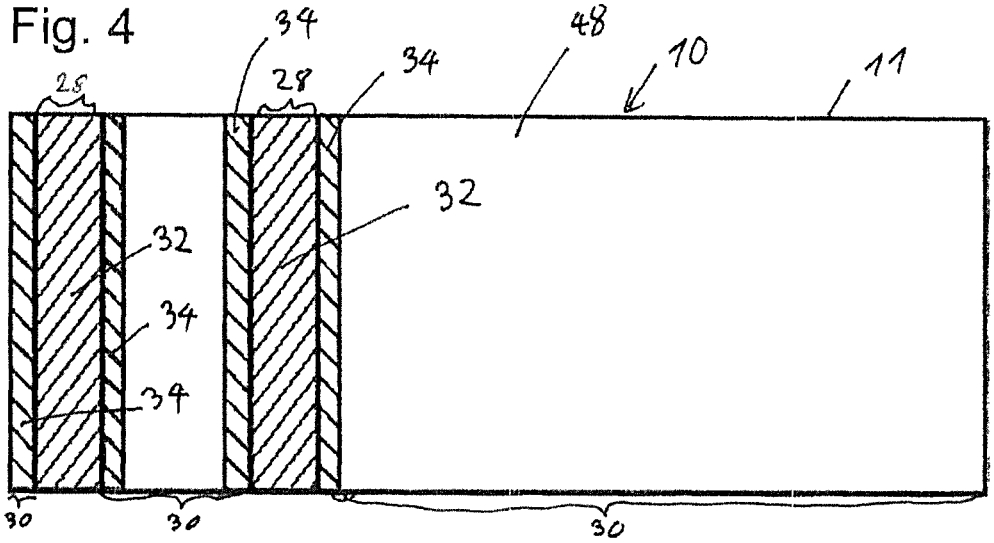
FIG. 4 shows a first exemplary embodiment of an adapter sleeve of the invention.

FIG. 4 shows a first exemplary embodiment of an adapter sleeve 10 of the invention. The adapter sleeve 10 has a sleeve body 11. The circumferential surface 48 of the sleeve body 11 is divided into a first proportion and a second proportion, with the first proportion of the circumferential face 48 being of porous and gas-permeable or air-permeable configuration, and being divided, in the embodiment shown in FIG. 4, into two porous regions 28. The second proportion of the circumferential face 48 is of gas-impermeable or air-impermeable design and is characterized in FIG. 4 as a gas-impermeable region 30.

The porous regions 28 of the circumferential face 48 are formed by a porous material 32, which is introduced into the sleeve body 11 using an adhesive 34. In the exemplary embodiment shown in FIG. 4, the porous regions 28 are configured as rings which circulate in the peripheral direction of the sleeve body 11. One of the porous regions 28 adjoins one of the end faces of the sleeve body 11, with that side of the porous material 32 that faces the end face being covered with the adhesive 34.

Figure 5:
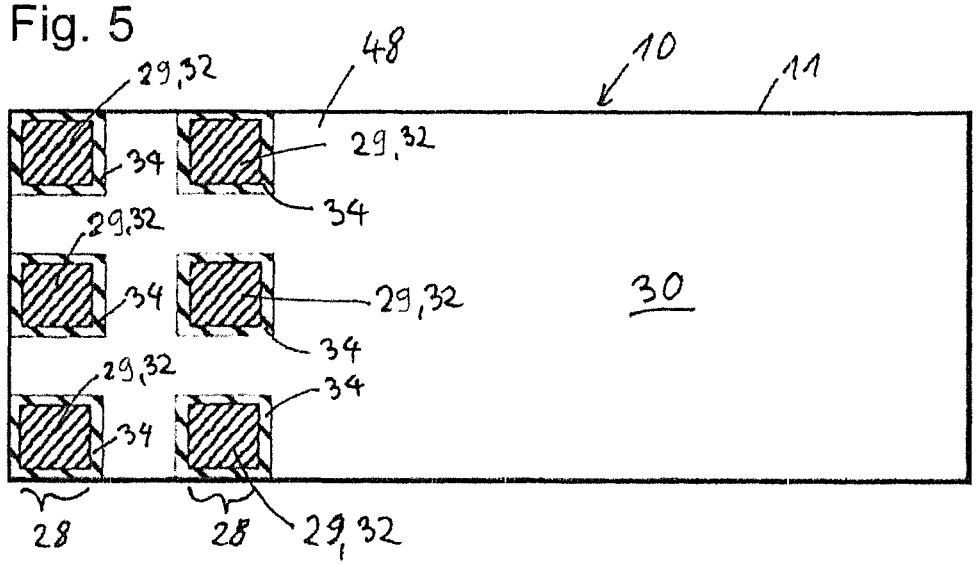
FIG. 5 shows a second exemplary embodiment of an adapter sleeve of the invention.

FIG. 5 shows a second exemplary embodiment of an adapter sleeve 10 of the invention. As already described with reference to FIG. 4, the adapter sleeve 10 has a sleeve body 11, in which a first proportion is of porous and gas-permeable configuration. The first proportion is again divided into two porous regions 28, and the porous regions 28 are configured in the form of interrupted rings, so that each of the two porous regions 28 comprises a plurality of subregions 29. The second-proportion of the circumferential surface 48 is gas-impermeable in design, and is characterized in FIG. 5 as a gas-impermeable region 30.

The porous regions 28, or their subregions 29, of the circumferential surface 48 are formed by a porous material 32 which is introduced into the sleeve body 11 using an adhesive 34. One of the porous regions 28, by its subregions 29, again adjoins one of the end faces of the sleeve body 11, with the sides of the porous material 32 of the subregions 29 that face the end face being covered in each case with the adhesive 34.

Figure 6:
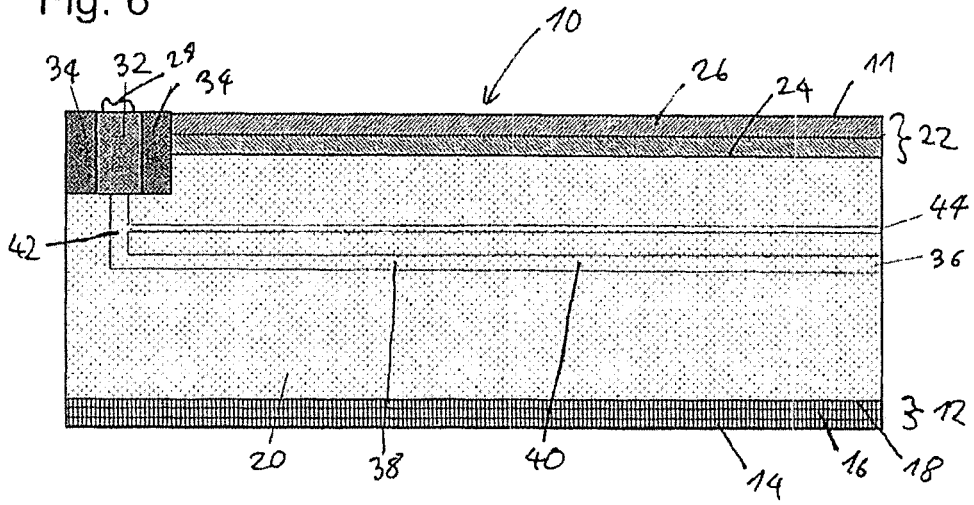
FIG. 6 shows a sectional view of an adapter sleeve of the invention with Airo system.

FIG. 6 shows a sectional view of an adapter sleeve 10 of the invention with Airo system. In the representation in FIG. 6, only a detail of one wall of the adapter sleeve 10 is visible.

The adapter sleeve 10 again has a sleeve body 11. In terms of its construction, the sleeve body 11 corresponds substantially to the adapter sleeves 10' according to the prior art. In the production of the adapter sleeves 10 of the invention, therefore, the initial steps traversed are the same as those traversed when producing adapter sleeves according to the prior art. First of all, the expandable base sleeve 12 is produced. The base sleeve 12 is implemented preferably as a base sleeve composed of glass fiber-reinforced plastic (GRP), and preferably comprises, in this order from inside to outside, a GRP layer 14, an expandable foam layer 16, and a further GRP layer 18. To build up the layer thickness, the foam layer 20 is applied to the GRP layer 18. The foam layer 20 consists preferably of a polyurethane (PU) foam. Subsequently a gas supply line in the form of channels 38 or grooves 40, 42 for the supply of gas into the foam layer 20 is milled or drilled. In this case at least one axial groove 40 is generated, which communicates with a compressed air connection 36. Additionally, radial grooves 42 are produced, which connect the axial grooves 40 to the porous regions 28. The channels 38 or grooves 40, 42 have a width of a few millimeters; a range from 2 mm to 6 mm is preferred.

When the axial grooves 40 and radial grooves 42 have been milled out in the foam layer 20, the outer layer 22 is applied. The outer layer 22 preferably comprises a barrier layer 24 and an outer foam layer 26. The outer foam layer 26 consists preferably of a polyurethane foam. Milled out subsequently at one end face of the sleeve body 11 is a recess into which, subsequently, the porous material 32 is adhesively bonded, in the form of a ring or in the form of a plurality of partial rings, for example. The depth of the recess is preferably 0.1 mm to 0.2 mm less than the wall thickness of the porous material 32, so that the latter stands slightly higher than the rest of the surface of the adapter sleeve 10. Where the porous material 32 used is a ring of porous aluminum, for example, it may be given an airtight adhesive bond to both sides with a two-part epoxy resin. The ring of porous material 32 here is preferably placed centrally over the width of the radial groove 42.

Optionally, the adapter sleeve 10 of the invention may also comprise additional axial bores 44. The diameter of these axial bores 44 is smaller than that of the radial grooves 42 and the axial grooves 42. Diameters of 1 mm up to 2 mm are preferred. The radial bores 44 end at a radial groove 42, and so the gas, the compressed air, for example, is able to escape via the axial bores 44 to the end face of the adapter sleeve 10 if too high a pressure is applied. In the normal case, however, the gas permeability of the porous material 32 is sufficiently high, and so the gas is conducted via the porous material 32 and any possible damage to the adapter sleeves 10 of the invention is ruled out.

Following the introduction of the porous material 32, the adapter sleeves 10 are ground or turned off on a lathe to the final dimensions on a CNC machine. Where insertion takes place using an adhesive, as for example a two-part epoxy resin, the mechanical reworking takes place after the adhesive has cured. Where the porous material used comprises porous aluminum, it can be ground or machined without problems, i.e., without impacting the porosity.

Lastly, the ends of the adapter sleeves 10 are customarily provided with metal rings. These rings serve as assembly aids and locking aids in the printing machine, and also serve to protect the end faces of the adapter sleeves 10. These end rings, however, are of no importance for the functioning of the adapter sleeves 10, and are not shown in the figures, Surprisingly it has been found that the pulling-on of printing sleeves onto the adapter sleeves of the invention operates more simply and more securely than in the case of prior-art adapter sleeves. A markedly lower quantity of air is needed during pulling-on. The uniformly porous surface results in a uniform air cushion, which is present immediately after the compressed air supply is switched on, and which improves the mounting and demounting of the printing sleeves. The noise produced in the surrounding area is considerably reduced. Whereas noise levels of >80 dB are measured when pulling a printing sleeve onto an adapter according to the prior art, the noise levels measured when pulling takes place onto the adapters of the invention are from only 50 dB to 65 dB, which corresponds to the customary soundscape in a press room.

Figure 7:
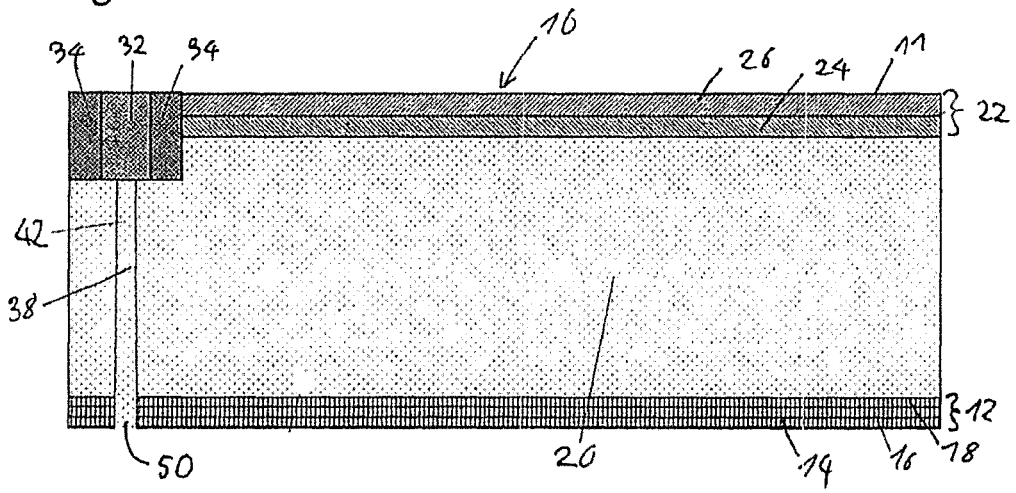
FIG. 7 shows a sectional view of an adapter sleeve of the invention with bridge system.

FIG. 7 shows how the adapter sleeves 10 of the invention may also be constructed according to the bridge system. Here, the compressed air is supplied through a gas inlet 50 in the form of a bore through the base sleeve and the foam layer 20, which ends in the radial groove 42. In order to provide a sufficient volume of compressed air, a multiplicity of gas inlets 50, depending on the diameter of the sleeve, preferably four gas inlets 50, are arranged, and are each placed at an angle of 90° on the inside of the adapter sleeve 10. The bores of the gas inlets 50 have a diameter of a few millimeters. The diameter corresponds preferably to the diameter of the radial groove 42. In order to enable very simple construction, the bores are mounted centrally below the radial groove 42. Over the length of the adapter sleeve 10 it is of course also possible to place a plurality of gas inlets 50 which end in an axial groove 40, as shown in FIG. 6, and so to guide the compressed air to the porous material 32.

Figure 1:
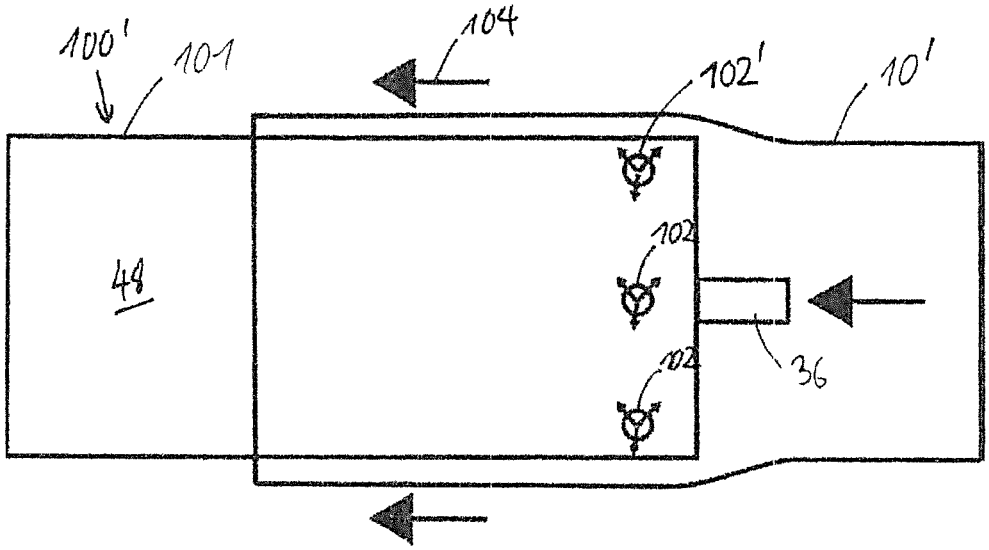
FIG. 1 shows the pulling of an adapter sleeve onto a printing forme cylinder in accordance with the prior art.
Figure 8:
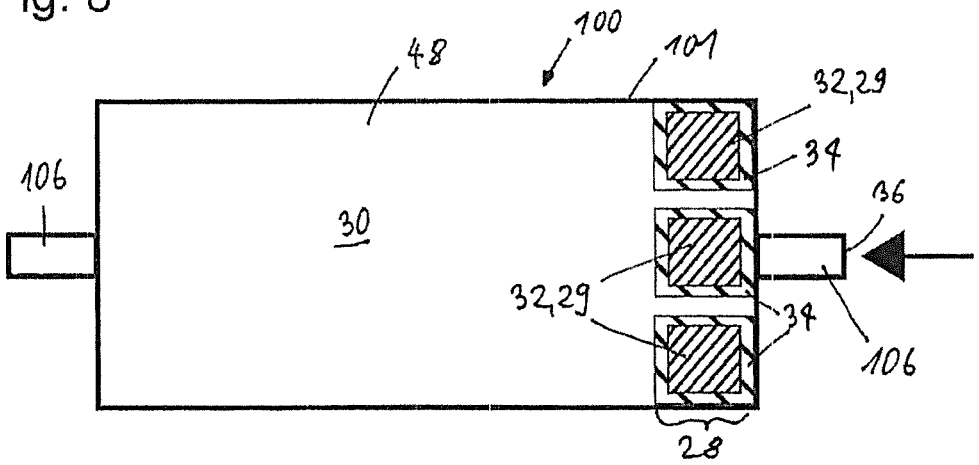
FIG. 8 shows an exemplary embodiment of a printing forme cylinder of the invention.

FIG. 8 shows a printing forme cylinder 100 which has a roll body 101 and one journal 106 on either side. The roll body 101 is manufactured preferably of steel and has a circle cylinder form. As in the case of the prior-art printing forme cylinder 100' described with reference to FIG. 1, the printing forme cylinder 100 has a gas connection 36 via which it may be charged with a gas—compressed air, for example.

The circumferential face 48 of the printing forme cylinder 100 has a porous region 28 which adjoins one of the end faces and which is subdivided into a plurality of subregions 29. In each of the subregions 29, the surface of the roll body 101 is formed by a porous material 32, which is inserted in the roll body 101 and is joined thereto by an adhesive 34.

The remaining portion of the circumferential face 48 is of gas-impermeable design and is characterized by the reference number 30.

Figure 9:
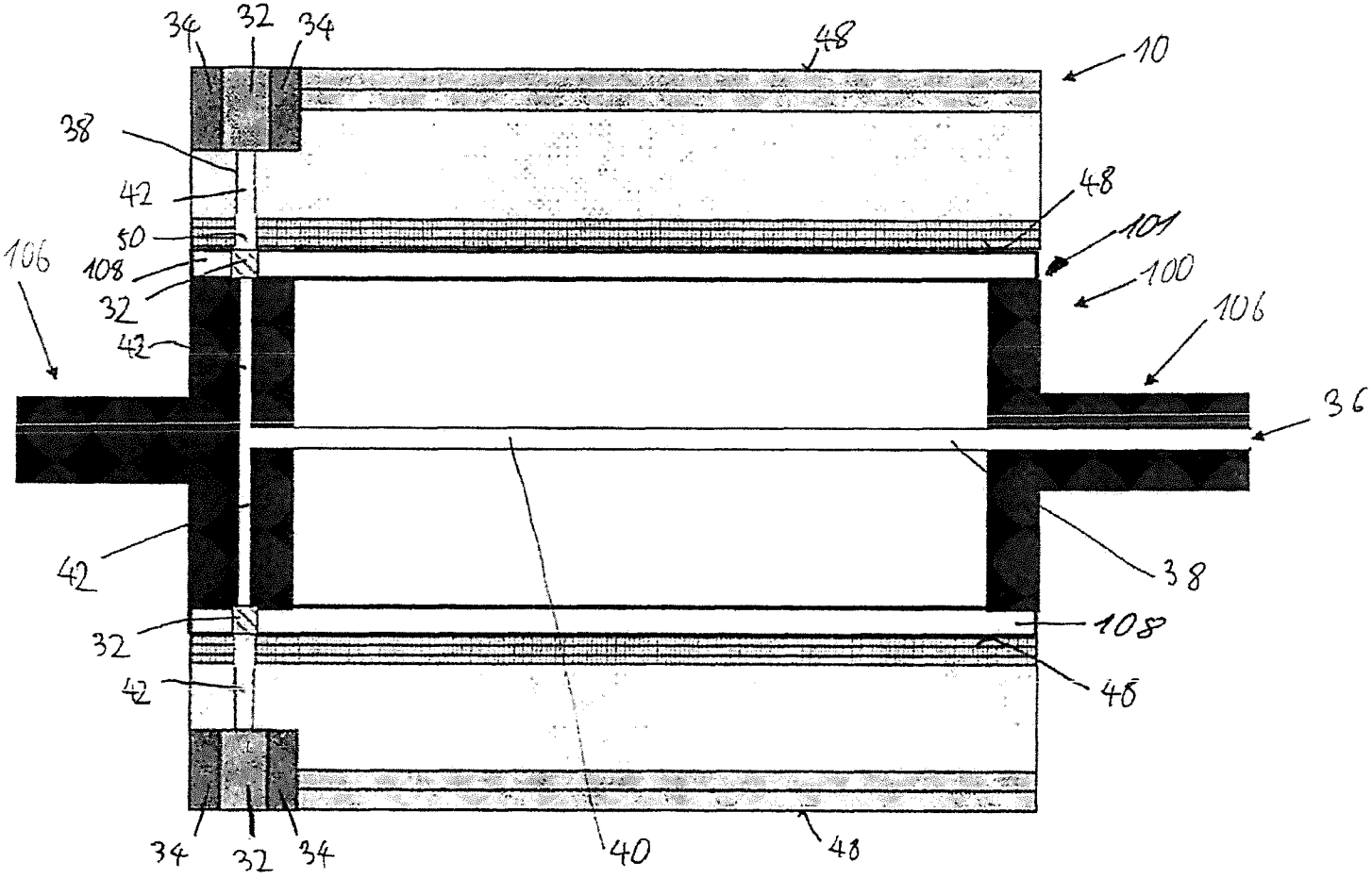
FIG. 9 shows an arrangement with a printing forme cylinder of the invention and an adapter sleeve of the invention.

FIG. 9 shows a printing forme cylinder 100, with an adapter sleeve 10 pulled onto it, in a sectional representation. The printing forme cylinder 100 comprises a tube 108 and has a journal 106 on each side, via which the printing forme cylinder 100 is mounted. The tube 108 is configured as a carbon tube with a thickness of 2 mm to several centimeters. Alternatively, the tube 108 is manufactured of stainless steel or of coated stainless steel. In this exemplary embodiment, the journals 106 are manufactured of aluminum. The tube 108 and the journals 106 together form the roll body 101 of the printing forme cylinder 100.

One of the journals 106 has a gas connection 36 via which the printing forme cylinder 100 can be charged with gas. On the circumferential face 48 of the printing forme cylinder 100 there are porous regions, formed by the insertion of porous material 32. An axial groove 48 and one radial groove 42 each connect the porous material 32 to the gas connection 36.

As already described with reference to FIG. 7, the adapter sleeve 10 is constructed according to the bridge system. The gas inlets 50 of the adapter sleeve 10 are in this case disposed in such a way that they each adjoin porous material 32 in the circumferential face 48 of the printing forme cylinder 100. In this way, the compressed air can be guided on via the porous regions of the printing forme cylinder 100 to the adapter sleeve 10.

Figure 10:
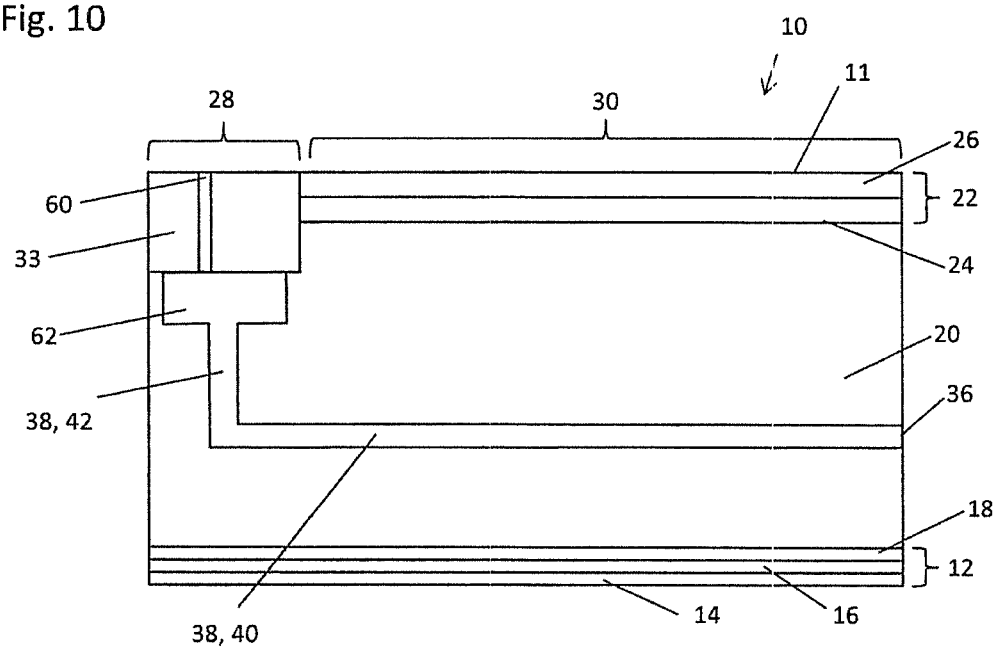
FIG. 10 shows a sectional view of a further exemplary embodiment of an adapter sleeve of the invention.

FIG. 10 shows a sectional view of a further exemplary embodiment of an adapter sleeve 10 of the invention. As in the case of the embodiment described with reference to FIG. 6, the adapter sleeve 10 is implemented with an Airo system. In the representation in FIG. 10, only a detail of one wall of the adapter sleeve 10 is visible.

The adapter sleeve 10 has a sleeve body 11 as described with reference to the embodiment of FIG. 6. Formed at one end of the adapter sleeve 10 is a porous region 28 in the form of a circulating ring. The remaining circumferential face of the adapter sleeve 10 is configured as a gas-impermeable region 30. The porous region 28 is formed by a material of high hole density 33, which is inserted in an indentation in the adapter sleeve 10. The material of high hole density 33 has at least one opening 60 per 500 $mm^2$ area. In the example illustrated in FIG. 10, the openings 60 are made as cylindrical openings in an otherwise gas-impermeable material.

In the sleeve body 11, a gas supply line is formed in the form of channels 38 and/or grooves 40, 42. The axial grooves 40 communicate with the compressed air connection 36. Radial grooves 42 are in communication with the axial grooves 40 and supply compressed air to a groove 62 which is formed beneath the porous region 28. The openings 60 in the porous region 28 configured as a material of high hole density 33 open into the groove 62, and so compressed air passes, starting from the compressed air connection 36, via the channels and/or grooves 40, 42, 62, to the openings 60.

The embodiment sketched in FIG. 10, in which the porous region 28 is formed by a material of high hole density 33, may also be combined with an adapter sleeve according to the bridge system or with a printing forme cylinder.

Figure 11:
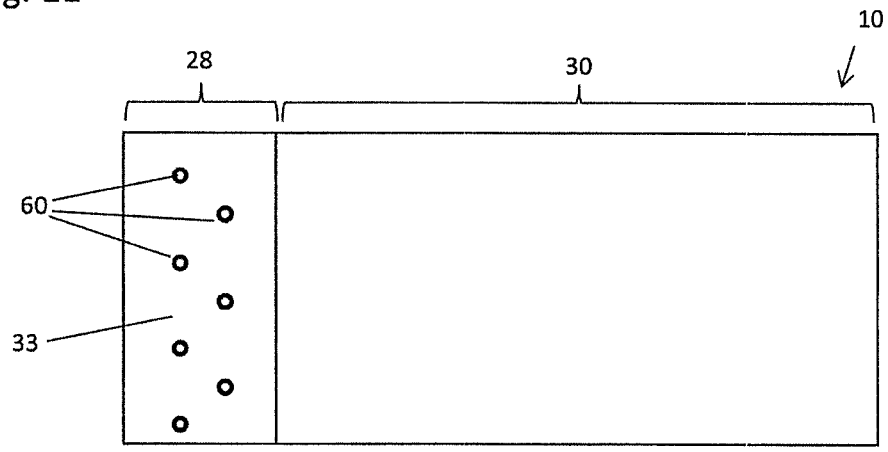
FIG. 11 shows an illustration of the surface of an adapter sleeve.

FIG. 11 shows a plan view of the surface or of the circumferential face of the adapter sleeve described with reference to FIG. 10. A first region of the surface is configured as a porous region 28. A second region of the surface is configured as a gas-impermeable region 30. The porous region 28 was generated by introducing a material of high hole density 33 into the adapter sleeve 10; the material of high hole density 33 has at least one opening per 500 $mm^2$ area. In the detail of the surface of the adapter sleeve 10, depicted in FIG. 11, there are six openings 60 visible in the porous region 28.

In the exemplary embodiment shown in FIG. 11, the porous region 28 is configured as a circulating ring; viewed in the peripheral direction of the adapter sleeve 10, the openings 60 are arranged in the form of two rows which are in an offset arrangement relative to one another.

EXAMPLES

Comparative Example 1

A Rotec Airo Adapter sleeve (available from Flint Group) with a length of 1.2 m is engaged by means of compressed air onto a steel cylinder with a length of 1.3 m which has an outer diameter of 130.623 mm. The inner diameter of the adapter sleeve is 130.623 mm, and thus corresponds exactly to the outer diameter of the steel cylinder. The outer diameter of the adapter sleeve is 191.102 mm Accordingly, the wall thickness of the adapter sleeve is 30.239 mm. The adapter sleeve has a compressed air connection on one end face and also, placed on one end and also centrally, has four radial air bores in each case, via which the compressed air emerges. The sleeve is then charged with compressed air (6 bar). A Rotec Bluelight printing sleeve having a wall thickness of 30 mm and an inner diameter which corresponds exactly to the outer diameter of the adapter sleeve is engaged over the adapter sleeve, from the side on which the air bores are located. The noise produced by the emerging compressed air is measured at a distance of 2 m from the experimental setup. The compressed air is then shut off and a determination is made of how firmly the printing sleeve is fixed on the adapter sleeve. The compressed air is then switched on again, and the printing sleeve is demounted. The operation is repeated 5 times and the mounted/demounting behavior is evaluated qualitatively:

Rating 1: very good, denoting easy engagement in a fluid operation, firmly seated adapted sleeve without compressed air, easy demounting when compressed air connected Rating 2: good, greater force required but otherwise reliable mounting/demounting and secure fixing Rating 3: satisfactory, greater force required, occasional sticking during mounting/demounting, secure fixing Rating 4: poor, high force required, mounting/demounting not possible in a fluid operation, and/or fixing inadequate Result of test:

Fitting characteristics: rating 2

Noise level: 80.1 dB

Comparative Example 2

The test is repeated except that instead of a Rotec Airo adapter sleeve, a Rotec Bridge adapter sleeve with identical dimensions is employed. The compressed air (6 bar) is applied to the steel cylinder, the adapter sleeve is fitted, and then the mounting/demounting behavior of a printing sleeve on the adapter sleeve is evaluated, and the noise level is measured as in comparative example 1.

Result of test:

Fitting characteristics: rating 2 to 3

Noise level: 82.3 dB

Compressed air throughput: 500 l/min

Inventive Example 1

An adapter sleeve 10 of the invention as shown in FIGS. 4 and 6 is produced with the same inner and outer diameters as in the case of comparative example 1. The foam layer 20 in a thickness of 20 mm is applied to the expandable base sleeve 12, which is 3 mm thick. Subsequently, at a distance of 20 mm from one end face, a radial groove 42 (6 mm wide, 12 mm deep) and additionally an axial groove 40 (6 mm wide, 12 mm deep) are milled as channels 38 into the foam layer 20. At the other end face, additionally, four axial bores (diameter 2 mm, each placed at a distance of 90 degrees) are made, which in turn extend to the radial groove 42 and serve for equalization of compressed air.

A GRP barrier layer 24 2 mm thick and an outer foam layer 26 6 mm thick are then applied to the foam layer 20. Thereafter the adapter sleeve is turned off on a lathe at one end face over a width of 12 cm to a depth of 9.8 mm. A ring of porous aluminum is bonded into the resultant recess, as porous material 32, with a porosity of 32% and a pore size of 22 μm. The ring has a width of 10 cm and a wall thickness of 10 mm. This ring is placed centrally onto the radial groove 42 (width 6 mm). An epoxy resin adhesive (Scotch-Weld 7271 from 3M) is used to bond the ring to the adapter sleeve 10 in an airtight bond. Subsequently, the end face of the adapter sleeve 10 as well is bonded and filled with the epoxy resin. After the curing of the adhesive 34, the ring is firmly joined to the adapter sleeve 10. It stands about 0.2 mm above the surface of the adapter sleeve 10.

For final machining, the adapter sleeve 10 is ground to the exact outer diameter of 191.102 mm and a gas connection 36 is mounted onto the axial groove 40. Surprisingly, the porous aluminum material can be machined or ground like metallic aluminum without impact on the porosity or on the gas permeability.

The adapter sleeve 10 of the invention is fitted onto a steel cylinder. The mounting behavior and the noise level when a printing sleeve is fitted are ascertained.

Result of test:
Fitting characteristics: rating 1
Noise level: 57.1 dB
Compressed air throughput: 80 l/min Inventive Example 2

An adapter sleeve 10 of the invention is produced as in test 1, except that, rather than a complete ring of porous aluminum, 4 partial rings with identical width and wall thickness are bonded into the recess via the radial groove 42. An advantage of this variant in accordance with the invention is that the recess is bounded on both sides by foam material 20 and the partial rings can be bonded in more easily.

Result of test:
Fitting characteristics: rating 1 to 2
Noise level: 62.3 dB
Compressed air throughput: 100 l/min The tests demonstrate impressively that printing sleeves can be fitted more simply and more securely and with substantially reduced noise pollution onto the adapter sleeves 10 of the invention than is the case for fitment onto adapter sleeves of the prior art.

Inventive Example 3

A printing forme cylinder 100 as described in relation to FIG. 9 was equipped with porous material. The cylinder consists of a carbon tube 108 with a thickness of 8 mm and an outer diameter of 187.187 mm, provided on each of the end faces with aluminum journals 106. The ⅛ inch gas connection extends over the axial and radial grooves in the interior of the cylinder and ends in a porous material implementation which is bonded into the aluminum journals 106 with a 2-part epoxy adhesive. The porous material used for the printing forme cylinder 100 of inventive example 3 is porous steel having a porosity of 20% and a pore size of 26 μm.

Result of test:
Fitting characteristics: rating 1 to 2

Inventive Example 4

An adapter sleeve 10 of the invention as described in inventive example 1 was applied as shown in FIG. 9 to the printing forme cylinder 100 described with reference likewise to FIG. 9.

Result of test:
Fitting characteristics: rating 1 to 2

Inventive Example 5

An adapter sleeve as described with reference to FIGS. 10 and 11 was produced. The outer diameter of the adapter sleeve is 175.187 mm. The porous region is configured as a circulating ring having a width of 23 mm. The porous region is implemented in the form of a material with a high density of openings, and the circulating ring has a total of 72 openings each with a diameter of 1 mm. The 72 openings are arranged in the form of two rows offset relative to one another, giving 36 openings per row. The distance of the first row from the edge of the adapter sleeve is 12.5 mm, and the distance of the second row to the edge of the adapter sleeve is 17.5 mm, and so the distance between the rows is 5 mm.

At 36 openings per row, the distance of each two openings in a row to one another is 10°. Based on the circumference of 175.187 mm, therefore, the distance between two openings in a row is approximately 4.87 mm. Relative to the circumference of the adapter sleeve, the holes of the two rows are each offset by 5° to one another.

The adapter sleeve of the invention is fitted onto a steel cylinder. A determination is made of the mounting behavior and of the noise level when a printing sleeve is fitted on.

Result of test:
Fitting-characteristics: rating 2
Noise level: 65 dB
Compressed air throughput: 100 l/min

LIST OF REFERENCE NUMERALS

10 adapter sleeve
10' prior-art adapter sleeve
11 sleeve body
12 base sleeve
14 GRP layer
16 expandable foam layer
18 further GRP layer
20 foam layer
22 outer layer
24 barrier layer
26 outer foam layer
28 porous region
29 subregion
30 gas-impermeable region
32 porous material
33 material with high density of openings
34 adhesive
36 gas connection
38 channel

38' air channel
40 axial groove
42 radial groove
44 axial bore
46' prior-art air holes
48 circumferential surface
50 gas inlet
50' air supply line
60 opening
62 groove
100 printing forme cylinder
100' prior-art printing forme cylinder
101 roll body
102 air bores
104 engagement direction
106 journal
108 tube

The invention claimed is:

1. A cylinder comprising a cylindrical body, characterized in that a first proportion of a circumferential face of the cylindrical body is of porous and gas-permeable configuration and a second proportion of the circumferential face of the cylindrical body is of gas-impermeable configuration, where the porous, gas-permeable first proportion of the circumferential face is in communication with at least one gas supply line and where the first proportion of the circumferential face amounts to at least 0.1% and at most 50%, characterized in that the porous, gas-permeable first proportion of the circumferential face is divided into at least one porous region, wherein the at least one porous region is configured as a ring circulating in the peripheral direction or as a plurality of subregions which are configured and disposed in the form of an interrupted ring circulating in the peripheral direction.

2. The cylinder as claimed in claim 1, characterized in that at least one porous region adjoins at least one end of the cylindrical body.

3. The cylinder as claimed in claim 1, characterized in that the porous, gas-permeable proportion of the circumferential face of the cylindrical body is formed of a porous material which is selected from the group consisting of a porous plastic, a porous, fiber-reinforced plastic, a porous metal, a porous alloy, a porous glass-ceramic, and a porous ceramic, and of combinations of at least two of the stated porous materials.

4. The cylinder as claimed in claim 3, characterized in that the porous material is porous aluminum or porous stainless steel.

5. The cylinder as claimed in claim 3, characterized in that the pores of the porous material have a proportion in the range from 1 vol % to 50 vol %.

6. The cylinder as claimed in claim 3, characterized in that the pore size of the porous material is in the range from 1 μm to 500 μm.

7. The cylinder as claimed in claim 1, characterized in that the cylinder is configured as an adapter sleeve comprising a sleeve body, where the sleeve body, viewed from inside to outside, comprises an expandable base sleeve, a foam layer, and an outer layer, characterized in that a first proportion of the circumferential face of the sleeve body is of porous and gas-permeable configuration and a second proportion of the circumferential face of the sleeve body is of gas-impermeable configuration.

8. The cylinder as claimed in claim 7, characterized in that the porous material is inserted in the foam layer.

9. The cylinder as claimed in claim 7, characterized in that one end face of the adapter sleeve has a gas connection which is in communication with the gas supply line.

10. The cylinder as claimed in claim 7, characterized in that the inside of the sleeve body has at least one gas inlet which is in communication with the gas supply line.

11. The cylinder as claimed in claim 1, characterized in that the cylinder is configured as a printing forme cylinder comprising a roll body, characterized in that a first proportion of the circumferential face of the roll body is of porous and gas-permeable configuration and a second proportion of the circumferential face of the roll body is of gas-impermeable configuration.

12. An arrangement comprising a cylinder as claimed in claim 1, characterized in that the cylinder bears at least one hollow cylindrical forme.

13. An arrangement comprising a first cylinder as claimed in claim 1 which is configured as a printing forme cylinder characterized in that the first cylinder bears at least one further cylinder as claimed in claim 1 which is configured as an adapter cylinder.

14. The arrangement as claimed in claim 13, characterized in that the porous, gas-permeable first proportions of the circumferential faces of the first cylinder and of the at least one further cylinder at least partially overlap one another.

15. The arrangement as claimed in claim 13, characterized in that the at least one further cylinder bears at least one hollow cylindrical forme.

16. A method for producing an arrangement comprising a cylinder as claimed in claim 1 and at least one hollow cylindrical forme, the method comprising the steps of:

a. providing the cylinder as claimed in claim 1,
b. connecting the cylinder to a gas supply,
c. charging the cylinder with gas,
d. applying the hollow cylindrical forme to the cylinder
e. positioning the hollow forme on the cylinder,
f. disconnecting the gas supply.

17. A method for producing an arrangement comprising a first cylinder as claimed in claim 1, which is configured as a printing forme cylinder, and a second cylinder as claimed in claim 1, which is configured as an adapter sleeve, the method comprising the steps of:

a. providing the first cylinder as claimed in claim 1 which is configured as printing forme cylinder,
b. connecting the first cylinder to a gas supply,
c. charging the first cylinder with gas,
d. engaging the second cylinder as claimed in claim 1 which is configured as adapter sleeve onto the first cylinder,
e. positioning the second cylinder on the first cylinder,
f. disconnecting the gas supply, and
g. optionally applying at least one further cylinder or a hollow forme.

* * * * *